US008180596B2

(12) United States Patent
Henning et al.

(10) Patent No.: US 8,180,596 B2
(45) Date of Patent: May 15, 2012

(54) METHODS AND APPARATUS FOR ASSEMBLING ROTATABLE MACHINES

(75) Inventors: Thomas Richard Henning, Cincinnati, OH (US); John Douglas Mickol, Cincinnati, OH (US); Daniel Edward Mollmann, Cincinnati, OH (US); Michael Harvey Schneider, Loveland, OH (US)

(73) Assignee: General Electric Company, Schenectady, NY (US)

( * ) Notice: Subject to any disclaimer, the term of this patent is extended or adjusted under 35 U.S.C. 154(b) by 1072 days.

(21) Appl. No.: 10/889,742

(22) Filed: Jul. 13, 2004

(65) Prior Publication Data

US 2006/0010686 A1 Jan. 19, 2006

(51) Int. Cl.
*G06F 17/50* (2006.01)

(52) U.S. Cl. ..... 703/1

(58) Field of Classification Search ..... 703/1
See application file for complete search history.

(56) References Cited

U.S. PATENT DOCUMENTS

| | | | | |
|---|---|---|---|---|
| 3,058,528 | A * | 10/1962 | Hiersch | 416/203 |
| 4,253,800 | A | 3/1981 | Segawa et al. | |
| 4,474,534 | A | 10/1984 | Thode | |
| 4,732,532 | A | 3/1988 | Schwaller et al. | |
| 4,767,272 | A | 8/1988 | Kildea | |
| 4,923,365 | A * | 5/1990 | Rollwage | 415/119 |
| 5,000,660 | A | 3/1991 | Van Houten et al. | |
| 5,096,383 | A * | 3/1992 | Dobrzynski | 416/200 R |
| 5,681,145 | A * | 10/1997 | Neely et al. | 416/203 |
| 5,966,525 | A | 10/1999 | Manzi, Jr. et al. | |
| 6,004,101 | A * | 12/1999 | Schilling et al. | 416/224 |
| 6,290,466 | B1 * | 9/2001 | Ravenhall et al. | 416/229 A |
| 6,908,285 | B2 * | 6/2005 | Henning et al. | 416/144 |
| 7,090,464 | B2 * | 8/2006 | Henning et al. | 416/61 |
| 7,416,389 | B2 * | 8/2008 | Henning et al. | 416/61 |
| 7,497,662 | B2 * | 3/2009 | Mollmann et al. | 416/144 |
| 7,572,101 | B2 * | 8/2009 | Mickol et al. | 416/1 |
| 2004/0093106 | A1 * | 5/2004 | Stuckey | 700/97 |

FOREIGN PATENT DOCUMENTS

EP 1382858 A1 1/2004

(Continued)

OTHER PUBLICATIONS

S. Akaike et al.; "Rotational Noise Analysis and Prediction for an Axial Fan with Unequal Blade Pitches", 1994, Presented at International Gas Turbine and Aeroengine Congress Exposition, The Hague, Netherlands, Jun. 16, 1994, ASME Paper 94-GT-356, pp. 1-7.*

(Continued)

*Primary Examiner* — Kandasamy Thangavelu
*Assistant Examiner* — Russ Guill
(74) *Attorney, Agent, or Firm* — David J. Clement, Esq.; Armstrong Teasdale LLP

(57) ABSTRACT

A processor-implemented method of assembling a rotatable machine is provided. The machine includes a plurality of blades that extend radially outwardly from a rotor. The method includes determining a geometric parameter for each blade in a row of blades that is relative to a ratio, R of an inlet area and an outlet area of a predetermined volume defined between each pair of blades, determining an initial sequence map for the row of blades that facilitates minimizing a difference of R between circumferentially adjacent pairs of blades, and iteratively remapping the sequence of the blades to facilitate reducing a moment weight vector sum of the rotor to a value that is less than a predetermined value.

20 Claims, 5 Drawing Sheets

FOREIGN PATENT DOCUMENTS

| | | | |
|---|---|---|---|
| EP | 1467063 | A1 | 10/2004 |
| GB | 2054058 | A | 2/1981 |

OTHER PUBLICATIONS

Y.A. Fiagbedzi; "Reduction of Blade Passage Tone by Angle Modulation", 1982, Journal of Sound and Vibration, vol. 82, Issue 1, pp. 119-129.*

Abstract of "Optimization of blade arrangement in a randomly mistuned cascade using simulated annealing", Edward Thompson et al., Jun. 1993, one page.*

Samir V. Amiouny et al.; "Heuristics for Balancing Turbine Fans", 2000, Operations Research, vol. 48, No. 4, pp. 591-602.*

R.C. Mellin et al.; "Controlling the Tonal Characteristics of the Aerodynamic Noise Generated by Fan Rotors", Mar. 1970, Transactions of the ASME, Journal of Basic Engineering, pp. 143-154.*

Wengang Zhai, "Optimal Blade Placement for Large Turbofan Balancing", 1994, Proceedings of the Fourth International Conference on Computer Integrated Manufacturing and Automation Technology, pp. 261-266.*

Axial Flow Compressor Noise Studies by J.M. Tyler and T.G. Sofrin, *Trans. S.A.E.*, 309-332 (1970).

French Patent Office, Preliminary Search Report and Translation of the Written Opinion on the Patentability of the Invention for Application No. FR0507001, Aug. 2, 2010, 4 pages.

* cited by examiner

METHODS AND APPARATUS FOR ASSEMBLING ROTATABLE MACHINES

BACKGROUND OF THE INVENTION

This invention relates generally to gas turbine engines and, more particularly, to methods and apparatus for assembling rotatable machines.

Gas turbines are used in different operating environments, such as, to provide propulsion for aircraft and/or to produce power in both land-based and sea-borne power systems. At least some known gas turbine engines include a core engine having, in serial flow arrangement, a fan assembly and a high pressure compressor that compress airflow entering the engine. A combustor ignites a fuel-air mixture that is then channeled through a turbine nozzle assembly towards low pressure and high pressure turbines. The turbines each include a plurality of rotor blades that extract rotational energy from airflow exiting the combustor.

At least some known turbofan gas turbine engines include a fan assembly that includes a plurality of fan blades extending radially outwardly therefrom. During normal operation, gas turbine engines may experience high rotational speeds, and any imbalance of the rotor may induce vibrational stresses to the rotor and/or rotor bearings and/or support structures. Over time, continued operation with such stresses may lead to premature failure of the bearings, bearing support structure, and/or rotor components.

Moreover, at least some known commercial jet engine fans operate with a relative blade tip Mach number in the transonic regime and may be subject to an operating characteristic called multiple-pure-tone (MPT) noise, or buzzsaw noise. Such noise may occur if at least some blades are oriented differently relative to other blades extending around the circumference of the fan case. Moreover, such noise may occur if blade-to-blade geometry variations exist within the fan and/or if flowfield disturbances are present forward of the fan inlet. Such flowfield disturbances may be caused by any number of factors including, but not limited to drain leakage, panel splice leakage, or other geometric nonuniformities. As a result, variations may exist within the fan assembly in the amplitude (strength) and/or spacing of the shockwaves originating from those portions of the blades that have sonic or supersonic velocities. Specifically, at axial locations close to the fan blades, the noise due to the shock waves is generally at multiples of the fan shaft per revolution frequency, which is the frequency with which one point on the shaft passes any particular fixed point as it rotates.

Shock waves of different strengths may propagate at different speeds. Accordingly, as the shock waves travel away from the blades, the noise at a blade passing frequency degenerates into a broad spectrum of lower frequency tones as the shock waves merge with each other. Buzzsaw noise may be an issue with passenger annoyance and comfort, and may also adversely affect community noise levels.

To facilitate minimizing imbalance and multiple pure tone noise of the fan during operation, at least some known fan assemblies are assembled in a controlled manner. For example, one control that may be used in assembling fan rotors involves mapping each fan blade into specific slots in the fan base. Within other known fan assemblies, a moment weight of each fan blade is determined and is used to map each blade into specific fan base slots. However, because the geometry of adjacent blades may be different, during operation a rotor may still experience a shift in balance and/or pure tone noise that is not associated with the moment weight of each blade.

BRIEF DESCRIPTION OF THE INVENTION

In one embodiment, computer-implemented method of assembling a rotatable machine is provided. The machine includes a plurality of blades that extend radially outwardly from a rotor. The method includes determining a geometric parameter for each blade in a row of blades that is relative to a ratio, R of an inlet area and an outlet area of a predetermined volume defined between each pair of blades, determining an initial sequence map for the row of blades that facilitates minimizing a difference of R between circumferentially adjacent pairs of blades, and iteratively remapping the sequence of the blades to facilitate reducing a moment weight vector sum of the rotor to a value that is less than a predetermined value.

In another embodiment, a rotor assembly is provided. The rotor assembly includes a disk having a plurality of circumferentially-spaced blade root slots defined therein, and a plurality of blades, each blade having a root, a tip, and an airfoil extending therebetween, each blade is positioned within a pre-determined slot based on a blade map wherein the blade map is generated by a computer system that is configured to determine a geometric parameter for each blade in a row of blades that is relative to a ratio, R of an inlet area and an outlet area of a predetermined volume defined between each pair of blades, determine an initial sequence map for the row of blades that facilitates minimizing a difference of R between circumferentially adjacent pairs of blades, and iteratively remap the sequence of the blades to facilitate reducing a moment weight vector sum of the rotor to a value that is less than a predetermined value.

In yet another embodiment, a computer system including a software product code segment for facilitating reducing multiple pure tone noise and imbalance in a bladed rotor is provided. The software code segment is programmed to determine a geometric parameter for each blade in a row of blades that is relative to a ratio, R of an inlet area and an outlet area of a predetermined volume defined between each pair of blades, determine an initial sequence map for the row of blades that facilitates minimizing a difference of R between circumferentially adjacent pairs of blades, and iteratively remap the sequence of the blades to facilitate reducing a moment weight vector sum of the rotor to a value that is less than a predetermined value.

DETAILED DESCRIPTION OF THE INVENTION

Figure 1:
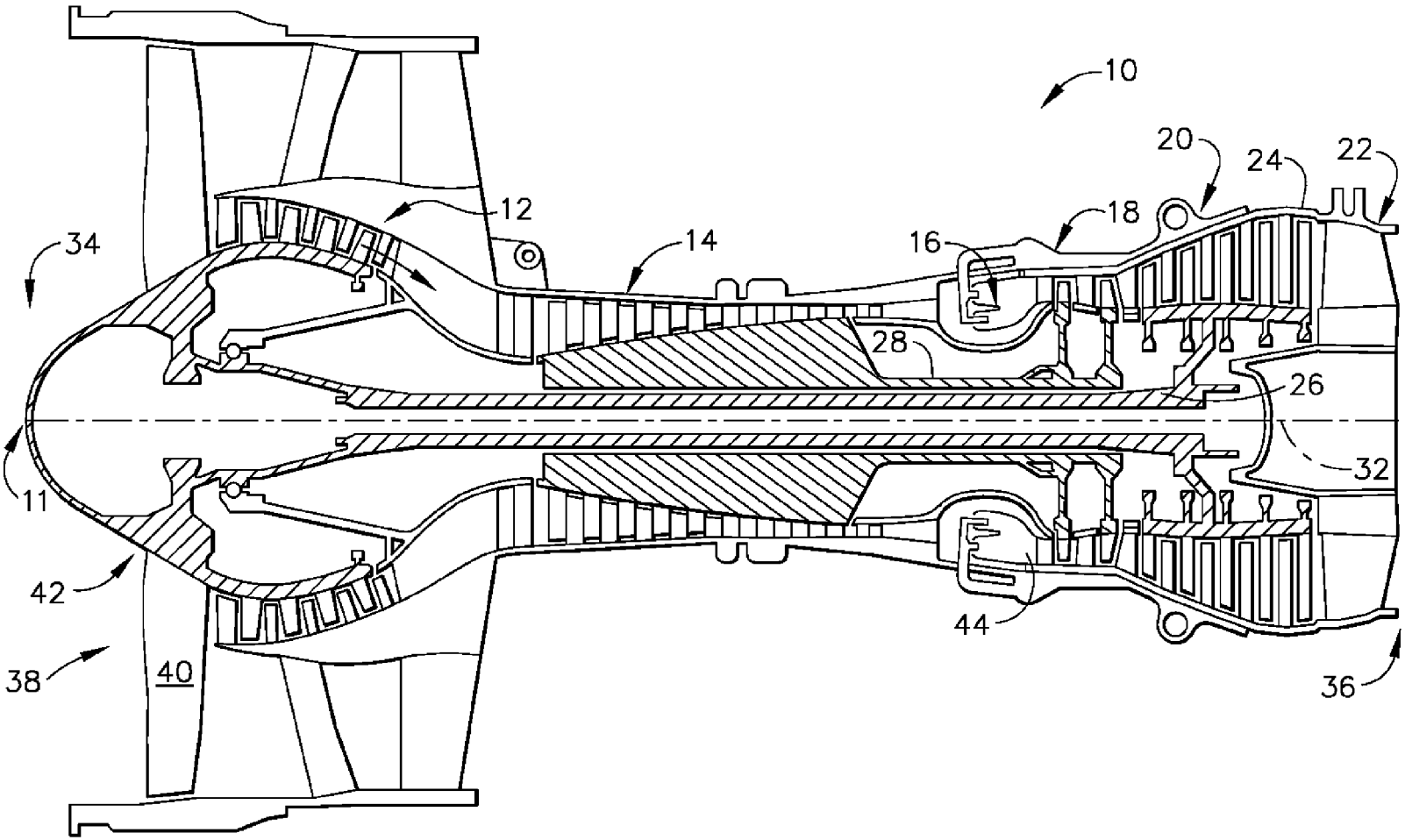
FIG. 1 is a schematic illustration of an exemplary gas turbine engine.

FIG. 1 is a schematic illustration of an exemplary gas turbine engine 10 including a rotor 11 that includes a low-pressure compressor 12, a high-pressure compressor 14, and a combustor 16. Engine 10 also includes a high-pressure turbine 18, a low-pressure turbine 20, an exhaust frame 22 and a casing 24. A first shaft 26 couples low-pressure compressor 12 and low-pressure turbine 20, and a second shaft 28 couples high-pressure compressor 14 and high-pressure turbine 18. Engine 10 has an axis of symmetry 32 extending from an upstream side 34 of engine 10 aft to a downstream side 36 of engine 10. Rotor 11 also includes a fan 38, which includes at least one row of airfoil-shaped fan blades 40 attached to a hub member or disk 42. Blades 40 are substantially identical with respect to each other blade 40, except that there is some small differences due to manufacturing tolerances. Blades 40 are coupled to disk 42 in a substantially equi-angularly spaced relationship to each other. In one embodiment, gas turbine engine 10 is a GE90 engine commercially available from General Electric Company, Cincinnati, Ohio and fan blades 40 are composite fan blades fabricated from a carbon fiber polymeric material and having a titanium leading edge, trailing edge, and tip cap.

In operation, air flows through low-pressure compressor 12 and compressed air is supplied to high-pressure compressor 14. Highly compressed air is delivered to combustor 16. Combustion gases 44 from combustor 16 propel turbines 18 and 20. High pressure turbine 18 rotates second shaft 28 and high pressure compressor 14, while low pressure turbine 20 rotates first shaft 26 and low pressure compressor 12 about axis 32. During some operations of engine 10, for example, during takeoff, and during operational periods when engine power output is relatively high, fan 38 rotates such that a radially outer portion of blades 40 attains supersonic velocity. As a result, the supersonically rotating portions of the blades produce shockwaves, which may be heard as noise. The noise may be spread over a broad tonal range, from blade passing frequency down to the disk rotational frequency.

Figure 2:
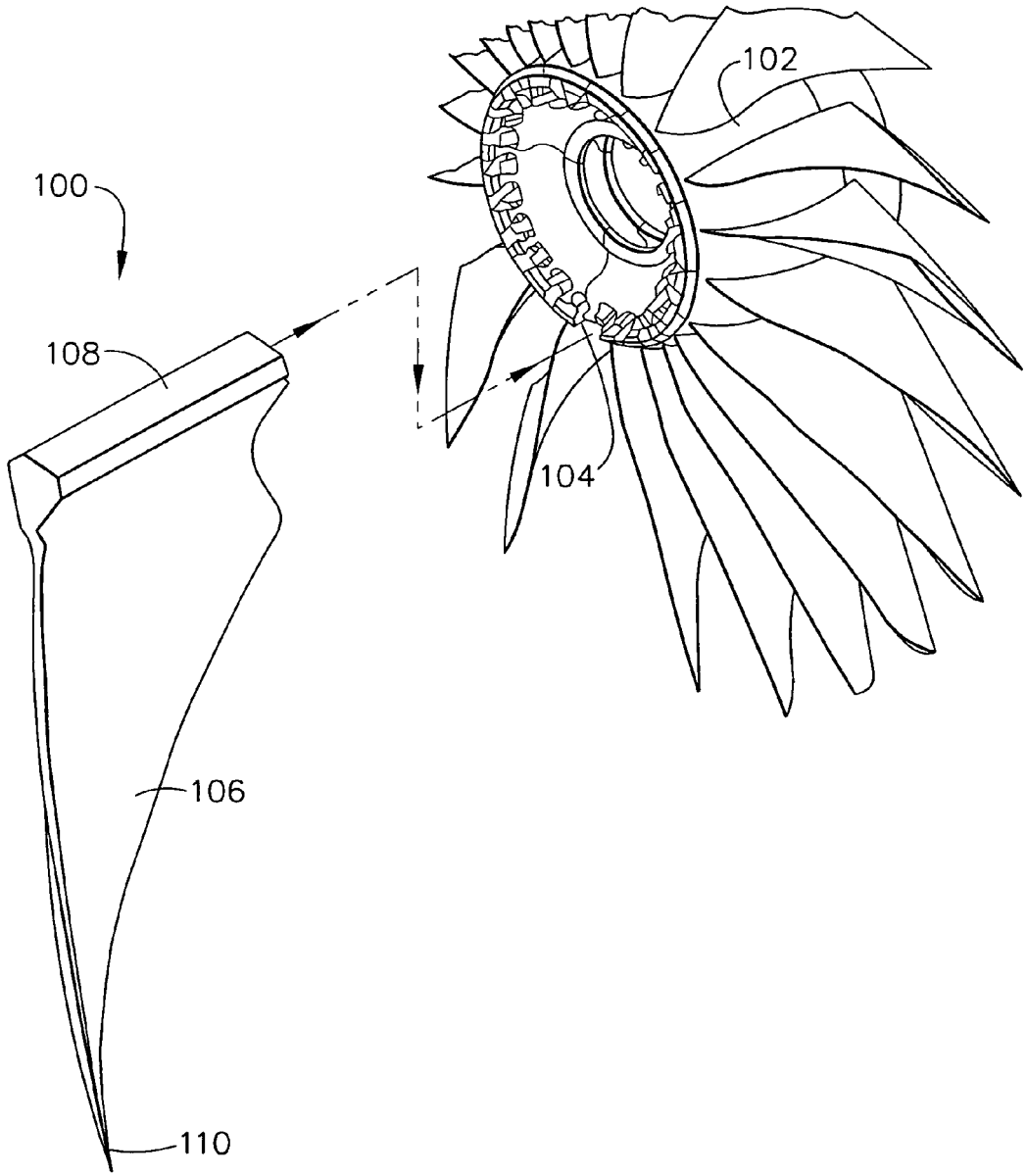
FIG. 2 is a perspective view of an exemplary fan rotor and blading assembly that may be used with the gas turbine engine shown in FIG. 1.

FIG. 2 is a perspective view of an exemplary composite fan blade 100 and fan rotor disk 102 that may be used with gas turbine engine 10. A plurality of circumferentially-spaced blades 100 is supported by rotor disk or drum 102 through a dovetail slot 104. Each blade 100 includes an airfoil 106 that extends between a dovetail root 108 and a blade tip 110 such that each blade 100 is supported through dovetail root 108 and dovetail slot 104 by rotor 102. Blade 100 is representative of a plurality of circumferentially-spaced blades 100 that are each mapped into a specific slot 104 based on measured parameters of blade 100. In the exemplary embodiment, each blade 100 includes a composite airfoil 106 that includes a plurality of layered composite plies (not shown). More specifically, each blade 100 includes a first plurality of structural and load-carrying airfoil plies in airfoil 106 and a second plurality of root plies in root 108.

Figure 3:
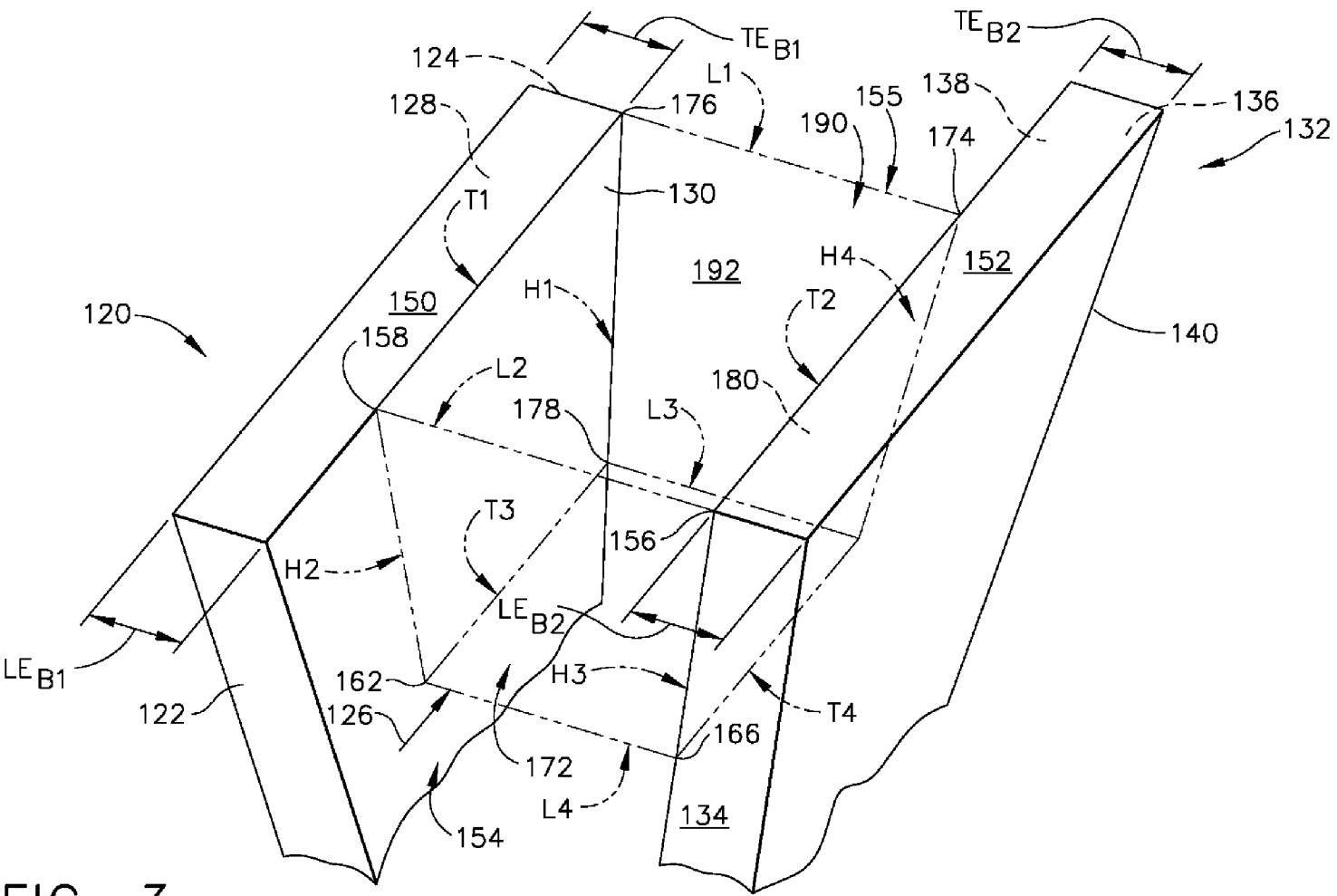
FIG. 3 is a simplified perspective view of a portion of the fan shown in FIG. 1.

FIG. 3 is a simplified perspective view of a portion of fan 38 that may be used with engine 10 (shown in FIG. 1). A first blade 120 includes a leading edge 122 and a trailing edge 124, which are spaced apart relative to a direction 126 of airflow through fan 38. First blade 120 includes a suction face 128 and a pressure face 130. A second blade 132 is adjacent to blade 120 and also includes a leading edge 134, and a trailing edge 136, a suction face 138, and a pressure face 140. Leading edges 122 and 134 each have a thickness, $LE_{B1}$ and $LE_{B2}$ respectively, and trailing edges 124 and 136 each have a thickness, $TE_{B1}$ and $TE_{B2}$ respectively. A tip surface 150 of blade 120 and a tip surface 152 of blade 132 define a radially outer periphery of blades 120 and 132.

In the exemplary embodiment, a passage 154 is defined between pressure face 130 and suction face 138, and is bounded by a plurality of lines 155 that join a plurality of points on pressure face 130 and suction face 138. A point 156 is defined at the junction of suction face 138, leading edge 134, and tip surface 152. A point 158 is defined at the junction of face 130, tip surface 150 and a line $L_2$ that is orthogonal to point 156. A point 162 is located a distance $H_2$ radially inward from point 158 and a point 166 is located a distance $H_3$ radially inward from point 156. Points 156, 158, 162, and 166 are connected by lines $L_2$, $H_2$, $H_3$, and a line $L_4$ that extends between points 166 and 162, such that an inlet area 172 is defined by lines $L_2$, $H_2$, $H_3$, and $L_4$. Similarly, adjacent to trailing edges 124 and 136, points 174, 176, 178, and 180 are connected together by lines $L_1$, $H_1$, $L_3$, and $H_4$ to define an outlet area 190. Lines $T_1$, $T_2$, $T_3$, and $T_4$ connect inlet area 172 and outlet area 190.

A volume 192 is defined between inlet area 172 and outlet area 190. In the exemplary embodiment, volume 192 approximates a diffuser type structure such that knowledge of diffusers may be applied to volume 192 during operation of fan 38. For example, as is known, flow through a diffuser structure and pressure differential across the diffuser are related to a ratio of the inlet area and outlet area of the diffuser. Accordingly, flow through volume 192 and a pressure differential across volume 192 are related to a ratio R of inlet area 172 and outlet area 190. Specifically, flow differences and variations of differential pressure across a plurality of volumes 192 that are circumferentially spaced about rotor 11 and are defined by inlet area to outlet area ratios that change from volume 192 to adjacent volume 192 may promote multiple tone noise and/or affect its onset. Minimizing a variation of the inlet area to outlet area ratio facilitates minimizing flow differences and variations of differential pressure across all of volumes 192 that are spaced circumferentially about rotor 11.

The inlet area to outlet area ratio R may be determined using:

$$R = \frac{Inlet.Area.172}{Outlet.Area.190}, \text{ where}$$

$$\text{Inlet Area } 172 = \frac{L_2 + L_4}{2} \times \frac{H_2 + H_3}{2}, \text{ and}$$

$$\text{Outlet Area } 190 = \frac{L_1 + L_3}{2} \times \frac{H_1 + H_4}{2}.$$

If $H_1$, $H_2$, $H_3$, and $H_4$ are selected to be a common value, for example H, the equation for R reduces to:

$$R = \frac{L_2 + L_4}{L_1 + L_3}$$

Using such a formula, L1, L2, L3, and L4 may be determined from geometric data for each blade that may be received from the blade manufacturer, or L1, L2, L3, and L4 may be determined empirically in the field, such as, for example, during an engine outage. L1, L2, L3, and L4 may also be determined geometrically using known and/or measurable blade parameters that depend from L1, L2, L3, and L4, such as, for example, using blade leading edge and trailing edge thicknesses, section twist, chord length, and/or section tangential shift.

Other rotor parameters that may be used to determine the initial blade sequence map include, but are not limited to:

a summation of the differences between inlet areas 172 of circumferentially adjacent volumes 192, defined as $$\sum_{i=1}^{n} |\text{Inlet_Area}_{i+1} - \text{Inlet_Area}_i|,$$

a summation of the differences between exit areas 190 of circumferentially adjacent volumes 192, defined as $$\sum_{i=1}^{n} |\text{Exit_Area}_{i+1} - \text{Exit_Area}_i|$$

a summation of the differences between circumferentially adjacent volumes 192, defined as $$\sum_{i=1}^{n} |Volume_{i+1} - Volume_i| +$$

a summation of the root sum squared values of the differences between inlet areas 172 of circumferentially adjacent volumes 192 and the difference between respective exit areas 190 of circumferentially adjacent volumes 192, defined as $$\sum_{i=1}^{n} \sqrt{(\text{Inlet_Area}_{i+1} - \text{Inlet_Area}_i)^2 + (\text{Exit_Area}_{i+1} - \text{Exit_Area}_i)^2}\text{, and}$$

a summation of the difference between the ratio of exit area 190 to inlet area 172 of circumferentially adjacent volumes 192, defined as $$\sum_{i=1}^{n} |\text{Exit_Area}_{i+1} / \text{Inlet_Area}_{i+1} - \text{Exit_Area}_i / \text{Inlet_Area}_i|,$$

where n represents a number of volumes 192 that are located in the row of blades.

Figure 4:
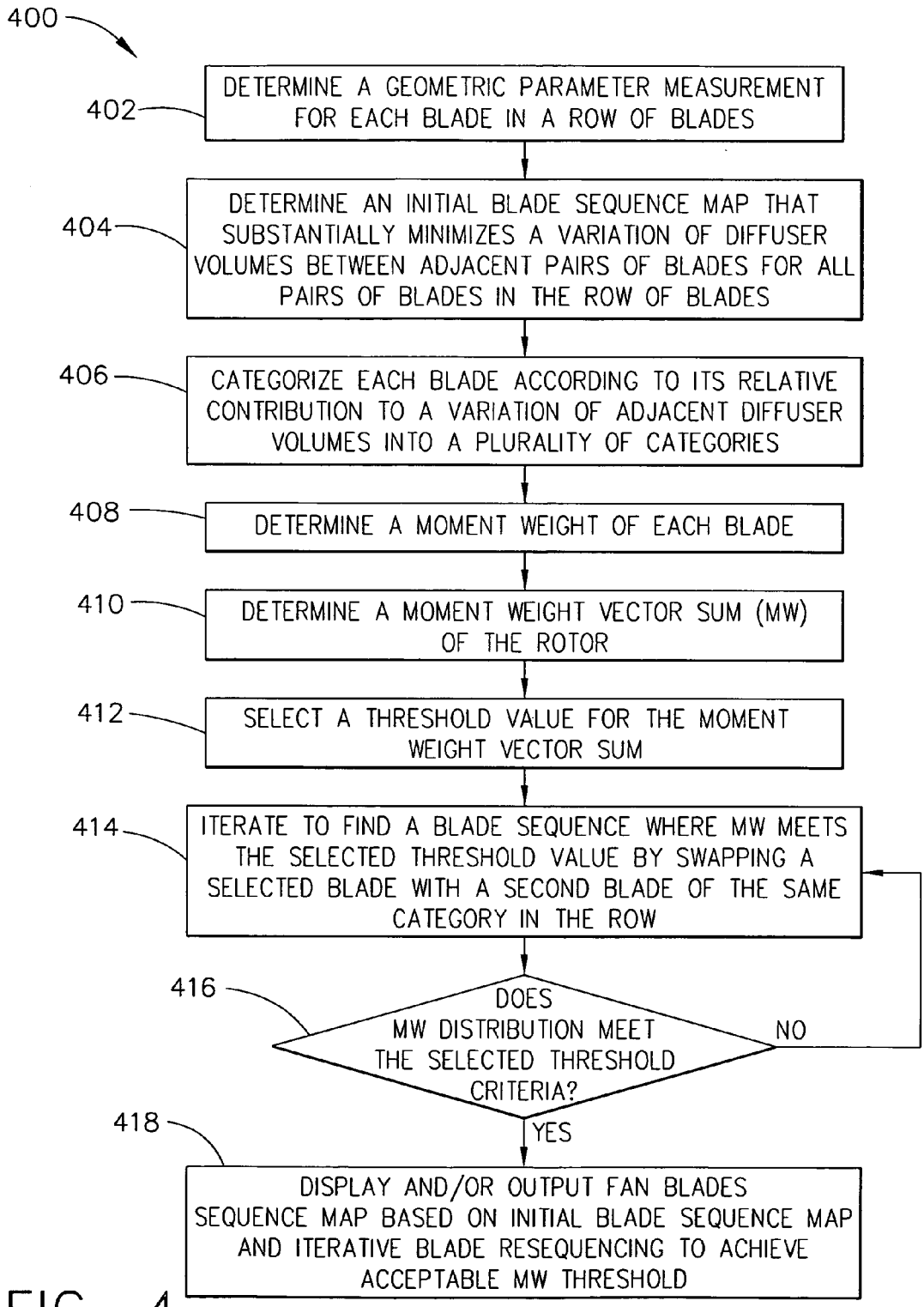
FIG. 4 is a flow diagram of an exemplary method for assembling a rotatable machine, such as the turbine engine shown in FIG. 1.

FIG. 4 is a flow diagram 400 of an exemplary method for assembling a rotatable machine, such as turbine 10 (shown in FIG. 1). In the exemplary embodiment, the machine is a gas turbine engine that includes a rotor, such as rotor 11, shown in FIG. 1, that is rotatable about a longitudinal axis of symmetry of the engine. The rotor includes a plurality of circumferentially-spaced slots for receiving the blades such that the blades extend radially outward from the slots.

The exemplary method includes receiving 402 a geometric parameter measurement of each blade positioned within a row of blades. The fan blade geometric parameter may be based on a determination by an acoustics specialist and fan aerodynamics specialist relative to a customer specification. The geometric parameter may also be based on any of a plurality of measurable blade parameters that contribute to a difference of a ratio of blade inlet area to blade exit area for adjacent blades. Such parameters may include, for example, distances of separation between respective predetermined points on adjacent blades. Each adjacent pair of blades defines a volume between the blades that includes an inlet area defined between a leading edge of the blades and an exit area defined between a trailing edge of the blades. An inlet area to exit area ratio R may be used to determine the geometric parameter that is used to map the blades into the rotor. The geometric parameter measurements may be received from a blade manufacturer, determined after the blade is received at a manufacturing facility, or determined in the field during a machine outage.

Prior to positioning blades within the rotor disk, an initial or starting blade map is determined 404. A blade map may indicate a specific slot for each blade that will be assembled into the rotor and/or may indicate an order of installation of the blades. The starting position may be a "virtual" position, in that the blades are simulated being installed using a computer model of the rotor and blades. Subsequent iterative maps of blade location may also be virtual maps until a predetermined endpoint is reached during iteration, at which time a final blade map may be displayed and/or printed. The initial blade map may also be determined using an algorithm executed on a processor-based computer. In the exemplary embodiment, a first blade is selected based on the received geometric parameters that indicate the blade will contribute more to a variation of inlet area to exit area ratio R between the first blade and any other blade that would be placed adjacent to it. A next largest contributor blade is selected for insertion into a slot that is diametrically opposed to the first blade. The next largest contributor is located in a slot that facilitates minimizing the variation of inlet area to exit area ratio from a pair of blades to each adjacent pair of blades. The remaining blades are then sequentially mapped into the rotor until all blades are positioned in the rotor.

To facilitate determining a mapping order, a computer, including a program code segment configured to select and deselect blades may be utilized. Specifically, when blades are selected to facilitate minimizing the variation of inlet area to exit area ratio R between adjacent pairs of blades around rotor 11, a first blade may be selected for positioning in a specific slot based on a contribution the blade makes to the inlet area to exit area ratio R variation between blade pairs. A second blade with the second largest contribution to the inlet area to exit area ratio R variation between blade pairs may then be selected for insertion into a slot located 180° apart from the first blade. The computer program iteratively selects the available blades in turn and matches them with complementary blades that will be positioned 180° apart from each selected blade until all blades are positioned in rotor 11.

The computer selects blades in an order that facilitates minimizing variation of inlet area to exit area ratio R between adjacent pairs of blades around rotor 11. During the process of minimizing the inlet area to exit area ratio R, it may be necessary to deselect blades from blade pairs and reorder the blades selected. The computer system may then display the resultant blade map and generate a report detailing the selection process. Additionally, manual entry of blade parameters and recalculation of the blade map are supported.

The inlet area and/or exit area may be determined using a distance between adjacent blades at the same radial distance from the blade tip. Because at least some of the parameters that may be used to determine inlet area and exit area may be fixed, only a line distance may be used to determine ratio of the inlet area and outlet area.

Each blade may be categorized 406 according to predetermined thresholds that define a degree to which each blade contributes to the inlet area to exit area ratio R variation between blade pairs, for example, large, medium, or small contribution.

A moment weight of each blade in a row of blades may be determined 408 and a moment weight vector sum of the rotor may also be determined 410. The moment weight may be determined by horizontally supporting a blade by its root in a device that is designed to measure moment weight. A moment weight is based not only on a pan weight of the blade but, also is based on a distribution of the weight of the blade along a radial distance extending between the blade root to the blade tip. In a rotating machine, an uneven distribution of moment weight of each blade spaced about the rotor may affect a balance condition of the rotor.

A threshold value for the moment weight vector sum of the rotor is determined 412. The threshold value may be determined from an engineering or design requirement contained within a drawing or other technical or administrative document. The initial blade sequence is iteratively remapped 414 by swapping a selected blade with a second blade of the same category. The moment weight vector sum of the rotor is recalculated and compared to the determined threshold value. If the moment weight vector sum of the rotor is reduced 416 to less than the determined threshold value, the final blade sequence map may be displayed 418 and/or output to hardcopy or other output. In one embodiment, a plurality of remapping sequences may be determined and the blade remapping sequence that facilitates minimizing a number of blade swaps that reduces the moment weight vector sum of the rotor to a value less than a predetermined limit may be selected from the plurality of determined blade remapping sequences.

Figure 5:
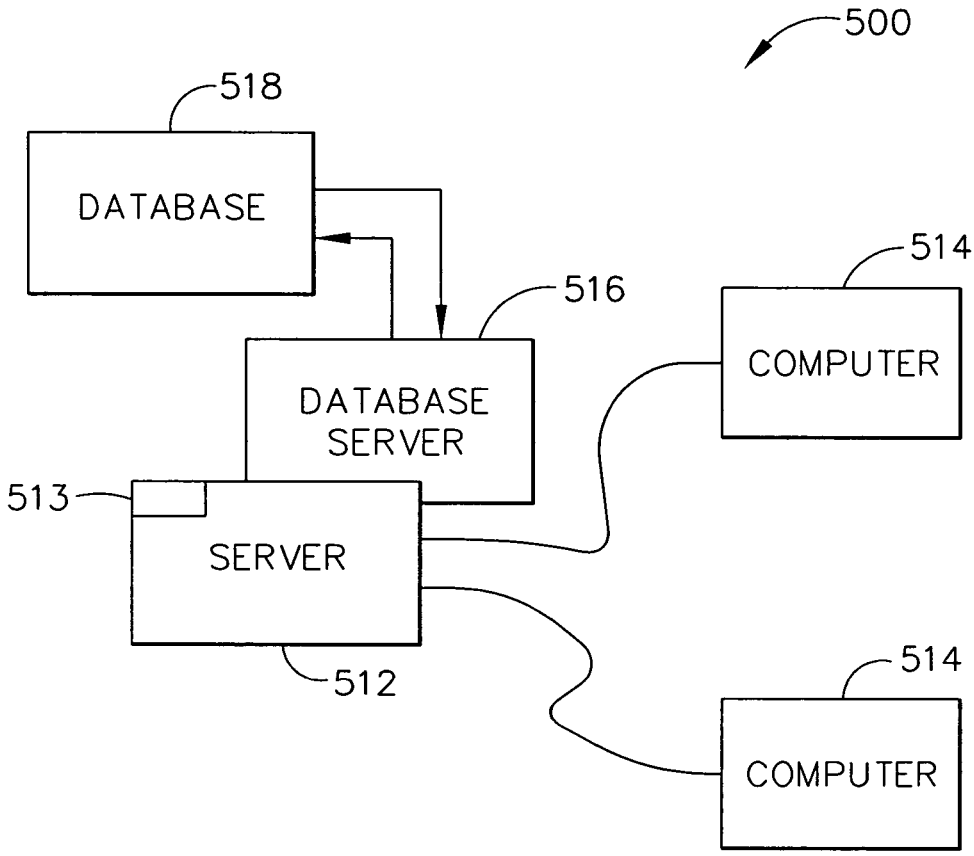
FIG. 5 is a simplified block diagram of an exemplary blade mapping computer system.

FIG. 5 is a simplified block diagram of a blade mapping computer system 500. As used herein, the term "computer" may include any processor-based or microprocessor-based system including systems using microcontrollers, reduced instruction set circuits (RISC), application specific integrated circuits (ASICs), logic circuits, and any other circuit or processor capable of executing the functions described herein. The above examples are exemplary only, and are thus not intended to limit in any way the definition and/or meaning of the term "computer". Computer system 500 includes a server system 512 including a disk storage unit 513 for data storage, and a plurality of client sub-systems, also referred to as client systems 514, connected to server system 512. In one embodiment, client systems 514 are computers including a web browser, such that server system 512 is accessible to client systems 514 via the Internet. Client systems 514 are interconnected to the Internet through many interfaces including a network, such as a local area network (LAN) or a wide area network (WAN), dial-in-connections, cable modems and special high-speed ISDN lines. Client systems 514 could be any device capable of interconnecting to the Internet including a web-based phone, personal digital assistant (PDA), or other web-based connectable equipment. A database server 516 is connected to a database 518 containing information regarding engine components. In one embodiment, centralized database 518 is stored on server system 512 and can be accessed by potential users at one of client systems 514 by logging onto server system 512 through one of client systems 514. In an alternative embodiment database 518 is stored remotely from server system 512 and may be non-centralized.

Exemplary embodiments of systems and methods that facilitate reducing multiple pure tone noise in aircraft gas turbine engine fans are described above in detail. A technical effect of the systems and methods described herein includes reducing overall circumferential pressure differences between adjacent blade pairs to minimize fan tonal noise, and therefore reducing aircraft passenger annoyance and community noise levels.

The above-described blade mapping system is a cost-effective and highly reliable method and system for determining a blade map that reduces a root sum squared value of a difference of a geometric parameter measurement between adjacent blades to a value that is less than a predetermined threshold. The method also iteratively remaps the blades to reduce a rotor moment weight vector sum to a value that is less than a predetermined threshold. Each system is configured to receive a geometric parameter measurement and a moment weight value for each blade, determine an initial blade location on the rotor, and generate a blade map based on iteratively reducing the root sum squared value of a difference of the geometric parameter measurement value between adjacent blades and the rotor moment weight vector sum to values that are less than predetermined respective threshold values. Accordingly, the blade mapping method and system facilitates assembly, operation, and maintenance of machines, and in particular gas turbine engines, in a cost-effective and reliable manner.

Exemplary embodiments of blade mapping method and system components are described above in detail. The components are not limited to the specific embodiments described herein, but rather, components of each system may be utilized independently and separately from other components described herein. Each blade mapping system component can also be used in combination with other blade mapping system components.

While the invention has been described in terms of various specific embodiments, those skilled in the art will recognize that the invention can be practiced with modification within the spirit and scope of the claims.

What is claimed is:

1. A method of assembling a rotatable machine that includes a plurality of blades that extend radially outwardly from a rotor, said method comprising:

determining, using a computer a geometric parameter for each blade in a row of blades that is relative to a ratio, R of an inlet area and an outlet area of a predetermined volume between each pair of blades;

determining, using the computer R using the determined geometric parameter;

determining an initial sequence map for the row of blades that facilitates minimizing a difference of R between circumferentially adjacent pairs of blades;

selecting, using the computer, each blade placement in a subsequent map based on the blade's contribution to a variation of R between each blade and adjacent blade in a pair of blades in the row of blades;

iteratively swapping and remapping the sequence of the blades, using the computer perform blade mapping, to facilitate reducing a moment weight vector sum of the rotor to a value that is less than a predetermined value;

outputting using the computer, a final blade map describing a location on the rotor to install each blade, the final blade map based on an endpoint of the remapping; and installing the blades on the rotor based on the final blade map.

2. A method in accordance with claim 1 further comprising categorizing each blade based on a determined contribution of the blade to R associated with the blade.

3. A method in accordance with claim 1 wherein determining an initial sequence map for the row of blades comprises determining an initial sequence map for the row of blades that facilitates minimizing at least one of a summation of the differences between inlet areas of circumferentially adjacent volumes, a summation of the differences between exit areas of circumferentially adjacent volumes, a summation of the differences between circumferentially adjacent volumes, a summation of the root sum squared values of the differences between inlet areas of circumferentially adjacent volumes and the difference between respective exit areas of circumferentially adjacent volumes, and a summation of the difference between the ratio of exit area to inlet area of circumferentially adjacent volumes for each blade.

4. A method in accordance with claim 1 wherein iteratively remapping the sequence of the blades comprises exchanging a first blade located in a first map position with a second blade, located in a second map position, of a same category as the first blade.

5. A method in accordance with claim 1 wherein iteratively remapping the sequence of the blades further comprises determining a remapping sequence that facilitates minimizing a number of blade exchanges used to facilitate reducing the moment weight vector sum of the rotor to a value less than a predetermined limit.

6. A method in accordance with claim 1 wherein determining a geometric parameter for each blade in a row of blades comprises receiving a geometric parameter for at least one of a sonic, a transonic, and a supersonic portion for each blade in the row of blades.

7. A rotor assembly comprising:

a disk comprising a plurality of circumferentially-spaced blade root slots defined therein; and a plurality of blades comprising geometric differences with respect to each other, each said blade comprising a root, a tip, and an airfoil extending therebetween, each said blade positioned within a pre-determined slot based on a blade map generated to minimize multiple pure tone noise, said blade map generated by a computer system configured to:

determine a geometric parameter for each blade in a row of blades that is relative to a ratio, R of an inlet area and an outlet area of a predetermined volume defined between each pair of blades;

determine R using the determined geometric parameter;

determine an initial sequence map for the row of blades that facilitates minimizing a difference of R between circumferentially adjacent pairs of blades;

select each blade placement in each subsequent map based on the blade's contribution to a variation of R between each of said plurality of blades in the row of blades;

iteratively swap and remap the sequence of the blades to facilitate reducing a moment weight vector sum of the rotor to a value that is less than a predetermined value; and output the final blade map, wherein, in the rotor assembly, when fully assembled, said plurality of blades are sequenced circumferentially in said disk such that a difference of R between a first adjacent pair of said plurality of blades is less than a determined difference of R between a second adjacent pair of said plurality of blades, said first and second pairs of blades being adjacent in the disk with respect to each other.

8. A rotor assembly in accordance with claim 7 wherein said computer system is further configured to categorize each blade based on a determined contribution of the blade to R associated with the blade.

9. A rotor assembly in accordance with claim 7 wherein said plurality of blades are composite fan blades.

10. A rotor assembly in accordance with claim 7 wherein said computer system is further configured to determine a ratio of an inlet area to an exit area that are defined between each pair of adjacent blades.

11. A rotor assembly in accordance with claim 7 wherein said computer system is further configured to determine an initial sequence map for the row of blades that facilitates minimizing at least one of a summation of the differences between inlet areas of circumferentially adjacent volumes, a summation of the differences between exit areas of circumferentially adjacent volumes, a summation of the differences between circumferentially adjacent volumes, a summation of the root sum squared values of the differences between inlet areas of circumferentially adjacent volumes and the difference between respective exit areas of circumferentially adjacent volumes, and a summation of the difference between the ratio of exit area to inlet area of circumferentially adjacent volumes for each blade.

12. A rotor assembly in accordance with claim 7 wherein said computer system is further configured to:

exchange a first blade located in a first map position with a second blade, located in a second map position, of a same category as the first blade; and determine a moment weight vector sum of the rotor with the first blade in the second map position and the second blade in the first map position.

13. A rotor assembly in accordance with claim 12 wherein said computer system is further configured to compare the determined moment weight vector sum of the rotor to the predetermined value.

14. A non-transitory computer readable medium on which is recorded computer executable instructions for use in facilitating reducing multiple pure tone noise and imbalance in a bladed rotor, said executable instructions when executed by a processor perform a process that:

prompts a user to select a plurality of blades for installation on the bladed rotor;

determines a geometric parameter for each blade in a row of blades that is relative to a ratio, R of an inlet area and an outlet area of a predetermined volume defined between each pair of adjacent blades;

determines R using the determined geometric parameter;

determines an initial sequence map for the row of blades that facilitates minimizing a difference of R between circumferentially adjacent pairs of blades;

selects each placement in a subsequent map based on a first blade's contribution to a variation of R between each blade and adjacent blade in a pair of blades in the row of blades;

iteratively swaps and remaps the sequence of the blades to facilitate reducing a moment weight vector sum of the rotor to a value that is less than a predetermined value; and outputs a final blade map describing a location on the rotor to install each blade, the final blade map based on an endpoint of the remapping.

15. A computer readable medium in accordance with claim 14 wherein said executable instructions when executed by a processor perform a process that categorizes each blade based on a determined contribution of the blade to R associated with the blade.

16. A computer readable medium in accordance with claim 14 wherein said executable instructions when executed by a processor perform a process that determines an initial sequence map for the row of blades that facilitates minimizing at least one of a summation of the differences between inlet areas of circumferentially adjacent volumes, a summation of the differences between exit areas of circumferentially adjacent volumes, a summation of the differences between circumferentially adjacent volumes, a summation of the root sum squared values of the differences between inlet areas of circumferentially adjacent volumes and the difference between respective exit areas of circumferentially adjacent volumes, and a summation of the difference between the ratio of exit area to inlet area of circumferentially adjacent volumes for each blade.

17. A computer readable medium in accordance with claim 14 wherein said executable instructions when executed by a processor perform a process that generates a blade sequence map that exchanges a first blade located in a first map position with a second blade, located in a second map position, of a same category as the first blade.

18. A computer readable medium in accordance with claim 14 wherein said executable instructions when executed by a processor perform a process that determines a blade remapping sequence that facilitates minimizing a number of blade swaps that reduces the moment weight vector sum of the rotor to a value less than a predetermined limit.

19. A computer-implemented method of assembling an aircraft gas turbine engine that includes a rotor assembly having a plurality of composite blades that extend radially outwardly from a plurality of circumferentially-spaced slots, said method comprising:

determining a geometric parameter for each blade in a row of blades that is relative to a ratio, R, of an inlet area and an outlet area of a predetermined volume defined between each pair of adjacent blades;

determining ratio R using the determined geometric parameter;

categorizing each blade based on a determined contribution of the blade to R associated with the blade;

determining an initial sequence map for the row of blades that facilitates minimizing a difference of R between circumferentially adjacent pairs of blades;

selecting each blade placement in a subsequent map based on the blade's contribution to a variation of R between each blade and adjacent blade in a pair of blades in the row of blades;

iteratively swapping and remapping the sequence of the blades, using a computer including a processor programmable with instructions to perform blade mapping, to reduce a moment weight vector sum of the rotor to a value that is less than a predetermined value;

exchanging a first blade located in a first map position with a second blade, located in a second map position, of a same category as the first blade;

outputting, using the computer, a final blade map that describes a location on the rotor to install each blade, wherein the final blade map is based on an endpoint of the remapping; and installing the blades on the rotor based on the final blade map, wherein, in the rotor assembly, when fully assembled, said plurality of blades are sequenced circumferentially in said disk such that a difference of R between a first adjacent pair of said plurality of blades is less than a determined difference of R between a second adjacent pair of said plurality of blades, said first and second pairs of blades being adjacent with respect to each other.

20. A method in accordance with claim 19 wherein determining an initial sequence map for the row of blades that facilitates minimizing a difference of R between circumferentially adjacent pairs of blades comprises determining an initial sequence map for the row of blades that minimizes at least one of a summation of the differences between inlet areas of circumferentially adjacent volumes, a summation of the differences between exit areas of circumferentially adjacent volumes, a summation of the differences between circumferentially adjacent volumes, a summation of the root sum squared values of the differences between inlet areas of circumferentially adjacent volumes and the difference between respective exit areas of circumferentially adjacent volumes, and a summation of the difference between the ratio of exit area to inlet area of circumferentially adjacent volumes for each blade.

* * * * *